US006758212B2

(12) United States Patent
Swann

(10) Patent No.: US 6,758,212 B2
(45) Date of Patent: Jul. 6, 2004

(54) PERSONAL EMERGENCY BREATHING SYSTEM

(75) Inventor: Linsey J. Swann, Vancouver (CA)

(73) Assignee: Brookdale International Systems, Inc., Vancouver (CA)

( * ) Notice: Subject to any disclaimer, the term of this patent is extended or adjusted under 35 U.S.C. 154(b) by 102 days.

(21) Appl. No.: 10/177,770

(22) Filed: Jun. 24, 2002

(65) Prior Publication Data

US 2003/0234016 A1 Dec. 25, 2003

(51) Int. Cl.[7] ..... A62B 07/10

(52) U.S. Cl. ..... 128/201.25; 128/201.26; 128/206.12; 128/206.15; 128/206.24; 128/206.29

(58) Field of Search ..... 128/200.24, 201.22–202.11, 128/205.27–207.13, 201.18

(56) References Cited

U.S. PATENT DOCUMENTS 4,154,235 A * 5/1979 Warncke ..... 128/201.25
4,807,614 A * 2/1989 van der Smissen et al. ..... 128/201.23
5,113,527 A * 5/1992 Robertson-McKenzie ..... 2/7
5,186,165 A * 2/1993 Swann ..... 128/201.28
5,315,987 A 5/1994 Swann
5,394,867 A * 3/1995 Swann ..... 128/201.25
5,526,804 A * 6/1996 Ottestad ..... 128/201.25
5,640,952 A * 6/1997 Swann et al. ..... 128/206.17
5,996,580 A * 12/1999 Swann ..... 128/206.17
6,016,802 A * 1/2000 Jackson ..... 128/205.25
6,041,778 A * 3/2000 Swann et al. ..... 128/201.25
6,102,034 A * 8/2000 Buhlmann ..... 128/201.29
6,340,024 B1 * 1/2002 Brookman et al. .... 128/201.25

* cited by examiner

*Primary Examiner*—Glenn K. Dawson
(74) *Attorney, Agent, or Firm*—Nixon & Vanderhye, P.C.; Richard G. Besha

(57) ABSTRACT

The breathing system includes an elastic, non-porous body housed within an outer protective shell. The body terminates at its forward end in a protective cap and an air inlet passage and at its inner face in oral and nasal cavities. An air filter is disposed in the body and a mouthpiece, including a bite block, is provided for communicating filtered air into the individual's mouth. The bite block has converging surfaces for biasing the mask toward the individual's face when the individual bites down on the block. A hood attached to the mask surrounds the individual's head and receives exhaled air through exhalation ducts communicating between the mouthpiece and the hood.

20 Claims, 7 Drawing Sheets

PERSONAL EMERGENCY BREATHING SYSTEM

TECHNICAL FIELD

The present invention relates to a low-cost self-contained disposable emergency breathing system for individual use and particularly relates to a compact system readily deployable for filtering ambient toxic air and exhausting exhaled air into and from a hood whereby breathable air for life support is provided over a predetermined length of time.

BACKGROUND

Self-contained emergency breathing systems have been proposed and constructed in the past. One such system is disclosed in U.S. Pat. No. 5,315,987, of common assignee herewith. In that system, a canister containing a filter includes a mouthpiece and a hood deployable upon opening the canister to envelop an individual's head. Nose clips are provided whereby when the individual grips the mouthpiece, ambient air flows into the filter and passes into the mouthpiece, supplying filtered breathable air to the individual. Upon exhalation, air passes through the mouthpiece into the hood, which loosely confines the individual's head. The exhaled air passes from the hood to atmosphere. While such system has proven eminently satisfactory in the past, it is desirable to provide a system having a mask in the form of an oral nasal cover. Many believe that an oral nasal cover has a negative pressure which induces inward leakage of the smoke or toxic gases, notwithstanding the conventional practice of employing a strap to secure the mask about the individual's face. It is therefore desirable to provide a mask which does not require a strap and which can be secured to the individual's face solely by biting down on a mouthpiece whereby the oral nasal mask can be readily, easily and quickly applied to the individual's face.

BRIEF SUMMARY OF THE INVENTION

In accordance with a preferred embodiment of the present invention, there is provided a personal emergency breathing system including an oral-nasal mask having a generally frustoconically-shaped body formed of an elastic non-porous material such as neoprene overlaid by a protective shell formed of a plastic material. The body has on a first surface oral and nasal cavities for overlying an individual's mouth and nose, respectively, and a peripheral seal for sealing about the individual's nose and mouth. The body also includes a chamber opening through a second surface at the forward end of the body opposite the first surface for receiving a filter. Preferably, the chamber is cylindrical and the filter is frictionally retained in the chamber. Overlying the forward end of the body is a protective, preferably luminescent disk or cap spaced from the chamber opening enabling ambient air to flow between the cap and the body into an air inlet of the filter. Air is thus transmitted through the filter into a mouthpiece carried by and projecting from the first body surface.

The mouthpiece projects from the first body surface and terminates in a bite block having a bulbous, outwardly converging surface for gripping by the individual's teeth. The pressure of the individual's teeth on the converging surface biases the mask for movement toward the individual's face, maintaining the peripheral seal about the body in sealing engagement about the individual's nose and mouth. The mouthpiece carries an inhalation check valve enabling inhalation of filtered air and excluding backflow of exhaled air into the filter. The mouthpiece also includes exhalation check valves enabling flow of exhaled air into the hood about the individual's head and preventing backflow of air from the hood into the mouthpiece.

In an alternate embodiment hereof, the chamber in the body has an opening through the first surface sized to receive the air filter. In this form, the air filter, mouthpiece, check valves and exhaust passages form a sub-assembly receivable in the chamber through the opening in the first surface. The body includes a pair of slots opening into the chamber and through the first surface for receiving exhalation ducts. As in the previous embodiment, the individual breathes filtered air passing through an air inlet at the forward end of the body, through the air filter, past the inhalation check valve and into the mouthpiece. Exhaled air passes into the mouthpiece and into the exhalation ducts for egress into the hood about the individual's head.

A substantially rigid shell is disposed about the conically-shaped surface of the body in both of the foregoing embodiments. The hood is preferably secured between the shell and outer margin of the body adjacent the seal. The hood has an opening, preferably with a drawstring, such that the hood can be disposed over the individual's head and drawn tightly, but not in sealing relation, about the individual's neck. A suitable hood for this purpose is described and illustrated in U.S. Pat. No. 5,113,527.

The air filter preferably is provided in stages having a particulate filter, a carbon filter and a monolithic filter formed of a ceramic substrate for converting carbon monoxide to carbon dioxide. Also, a Hepa filter can be used if desired. It will be appreciated that the system is constructed about the elastic non-porous body which not only ensures a seal about the individual's face but also anchors the mouthpiece, hood and shell and provides a chamber in which the filter can be inserted and replaced as needed. The elastic body also serves as a shock-absorbing mass about the filter, provides a nasal cavity, as well as nose pads, to close the individual's nose and, in one embodiment, forms ducts enabling escape of exhaled air from the mouthpiece into the hood and through the neck opening of the hood into the atmosphere.

It will be appreciated that with the foregoing construction a combined oral/nasal cup and mouthpiece with the attendant advantages of each are provided. The oral/nasal cup provides a comfortable fit without the need for a nose clip and the need to apply such clip about the individual's nose. The mouthpiece greatly improves the seal between the filtered air and exhaled air/smoke or toxic gas.

In a preferred embodiment according to the present invention, there is provided a personal emergency breathing system comprising a shaped body formed of an elastic non-porous material having along a first surface thereof a perimetrical seal for sealing about an individual's nose and mouth, a mouthpiece carried by the body and projecting from the first surface thereof terminating in a bite block for gripping by the individual's teeth, the bite block being shaped to draw the body toward the individual's face to maintain the seal about the individual's nose and mouth upon the individual biting down on the bite block, the body having a chamber with an opening through one of the first surface and a second surface opposite the one surface and in communication with the mouthpiece, an air filter disposed in the chamber for filtering ambient air and having an air inlet for receiving ambient air and an air outlet for passing filtered air into the mouthpiece, a substantially rigid shell about the body and extending substantially between the first and second surfaces thereof, a hood about the first surface for enveloping an individual's head and having an opening for receiving an individual's head and neck and first and second one-way valves carried by the mouthpiece, the first valve enabling flow of filtered air from the filter air outlet into the mouthpiece and preventing backflow of exhaled air into the filter, the second valve enabling air exhaled into the mouthpiece for flow into the hood and preventing backflow of air from the hood through the second valve to the mouthpiece.

In a further preferred embodiment according to the present invention, there is provided a personal emergency breathing system comprising a mask including a shaped body formed of an elastic non-porous material having along a first surface thereof a perimetrical seal for sealing about an individual's nose and mouth, a mouthpiece carried by the body and projecting from the first surface thereof terminating in a bite block for gripping by the individual's teeth, the bite block being shaped to draw the mask toward the individual's face to maintain the seal about the individual's nose and mouth upon the individual biting down on the bite block, the body having a chamber with an opening through one of the first surface and a second surface opposite the one surface and in communication with the mouthpiece, an air filter disposed in the chamber for filtering ambient air and having an air inlet for receiving ambient air and an air outlet for passing filtered air into the mouthpiece, the mask including a substantially rigid shell about the body and extending substantially between the first and second surfaces thereof, a hood carried by the mask about the first surface for enveloping an individual's head and having an opening for receiving an individual's head and neck and first and second one-way valves carried by the body, the first valve enabling flow of filtered air from the filter air outlet into the mouthpiece and preventing backflow of exhaled air into the filter, the second valve enabling air exhaled into the mouthpiece for flow into the hood and preventing backflow of air from the hood through the second valve to the mouthpiece.

BEST MODE FOR CARRYING OUT THE INVENTION

Figure 1:
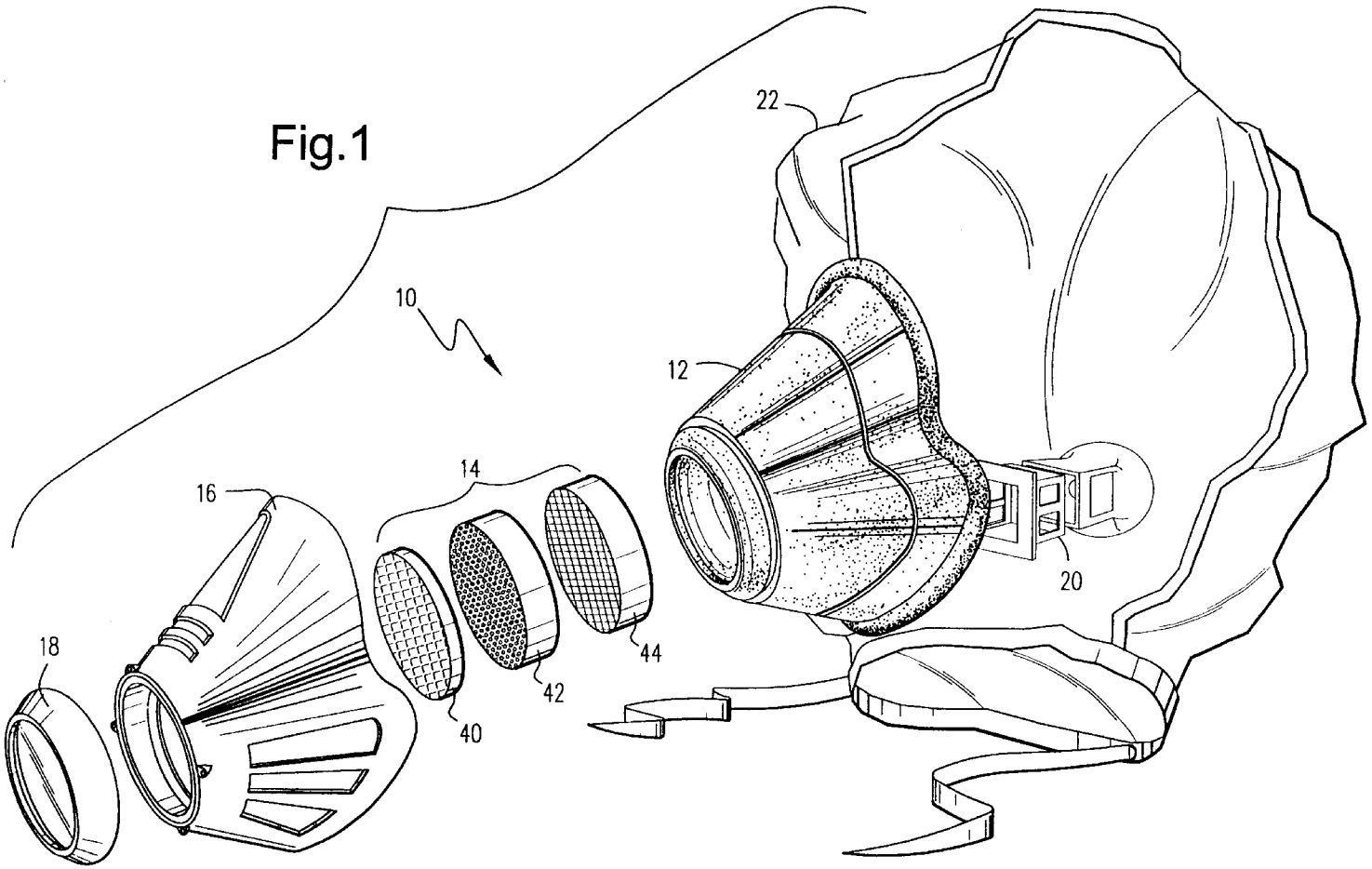
FIG. 1 is an exploded perspective view of an emergency breathing system constructed in accordance with the present invention.
Figure 2:
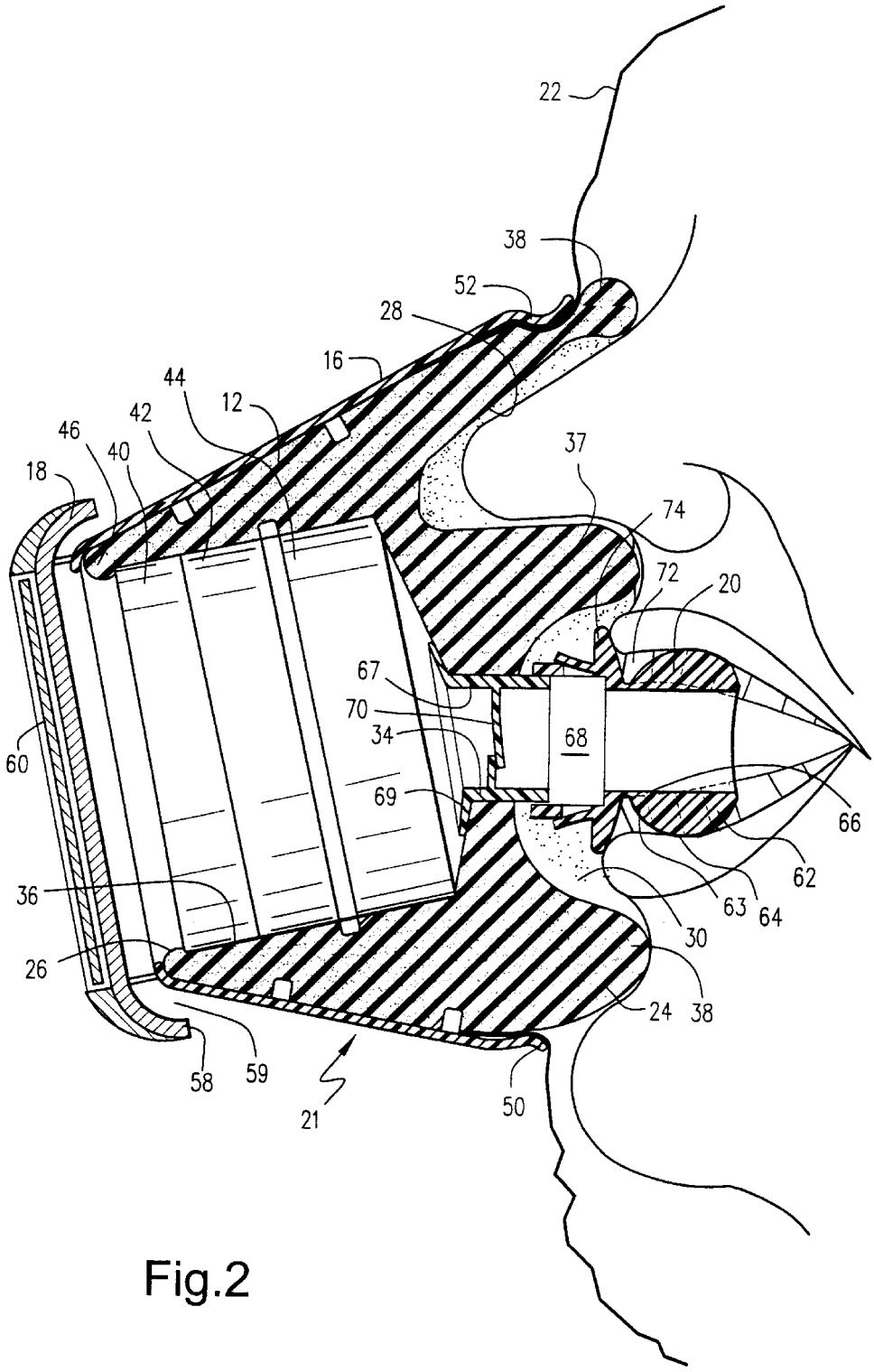
FIG. 2 is a cross-sectional view thereof illustrating the system applied to an individual's head.
Figure 3:
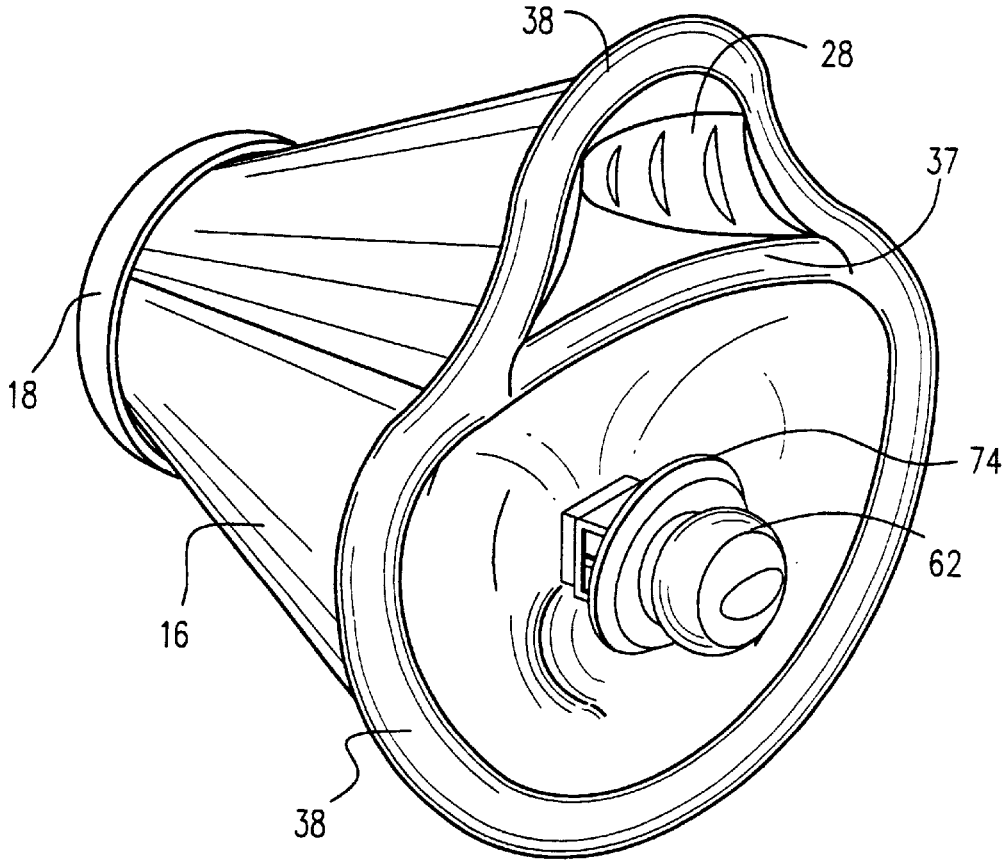
FIG. 3 is a perspective view of the mask of the system as viewed from the surface registering with the individual's face.
Figure 4:
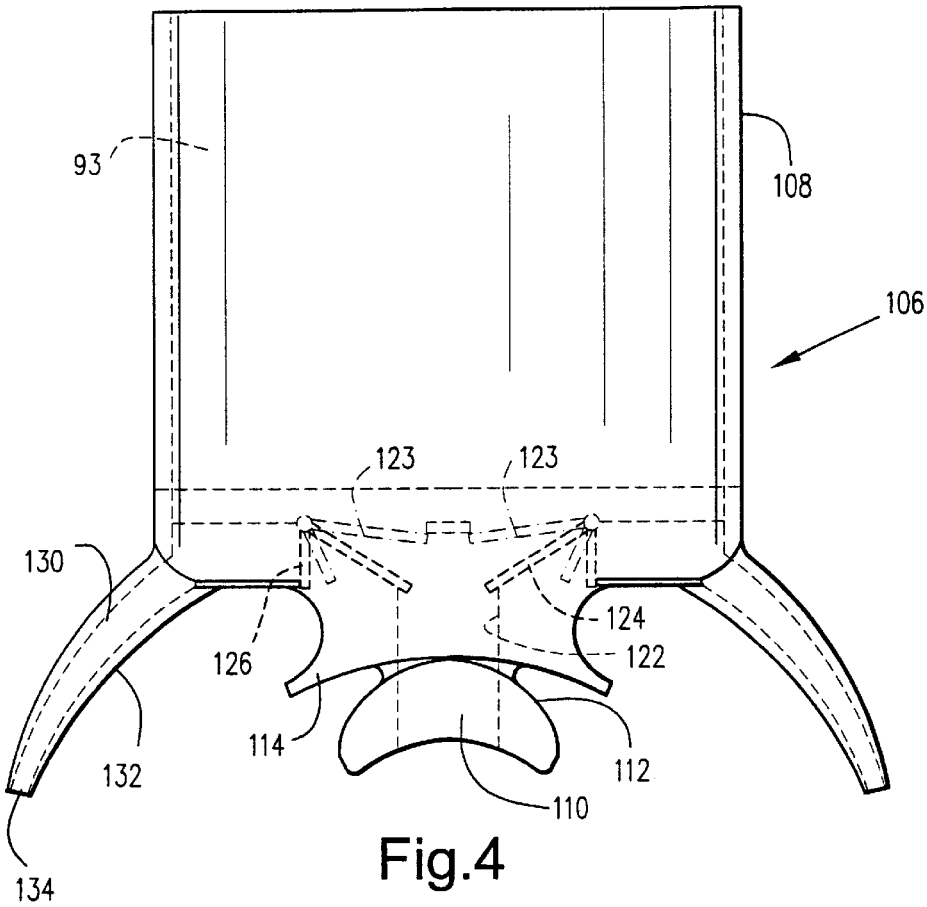
FIG. 4 is a top plan view of a sub-assembly including an air filter, mouthpiece, check valves and exhalation ducts forming part of the system in a further embodiment thereof.
Figure 5:
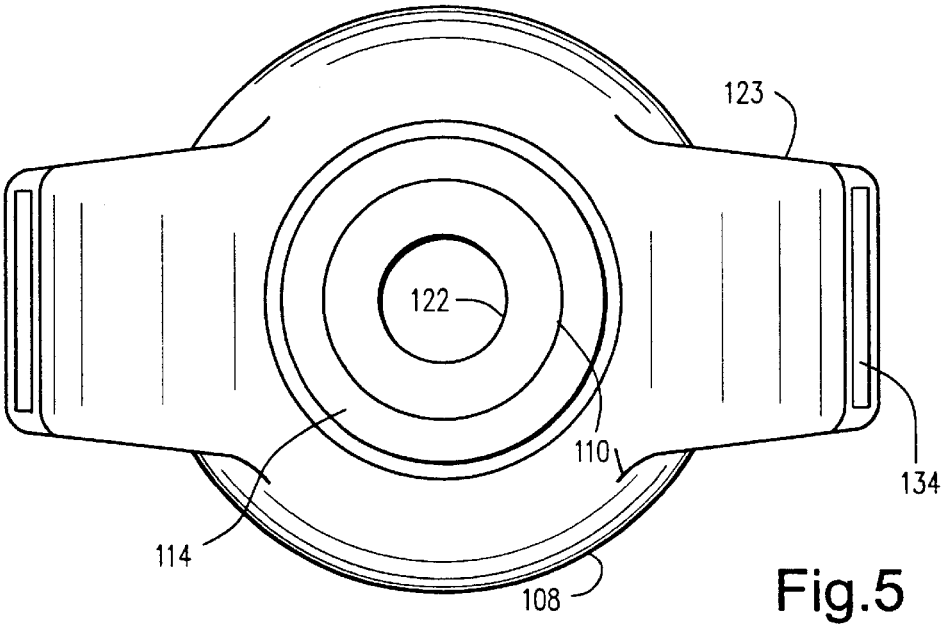
FIG. 5 is an end view of the sub-assembly illustrated in FIG. 4.
Figure 6:
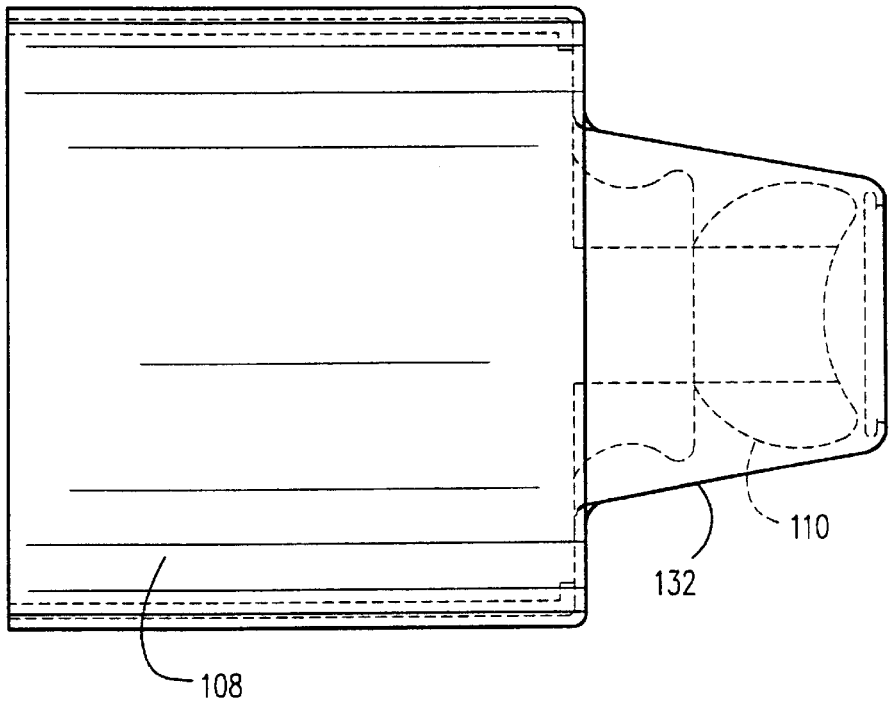
FIG. 6 is a side elevational view of the sub-assembly.
Figure 7:
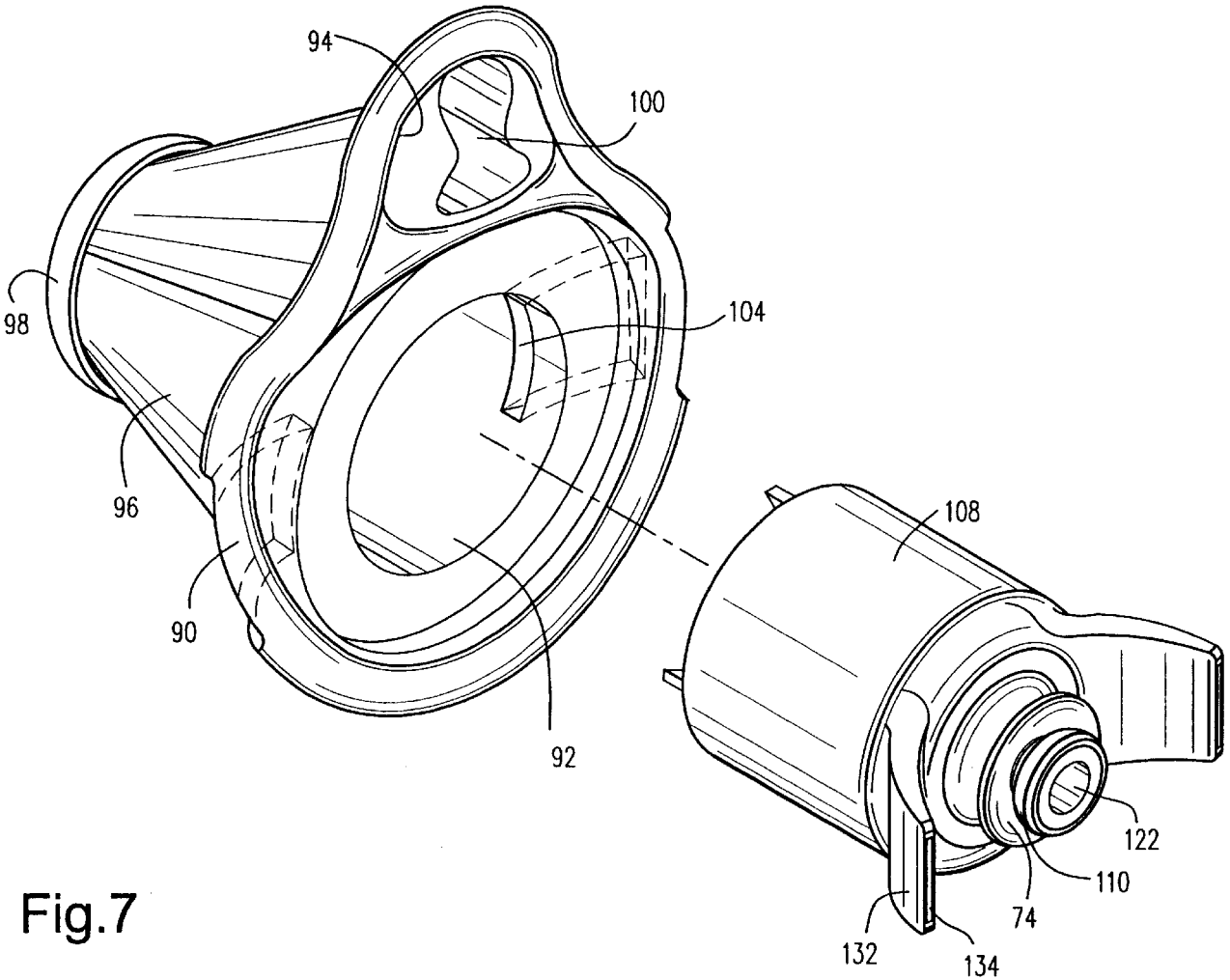
FIG. 7 is a perspective view of the sub-assembly poised for insertion into the body of the system.
Figure 8:
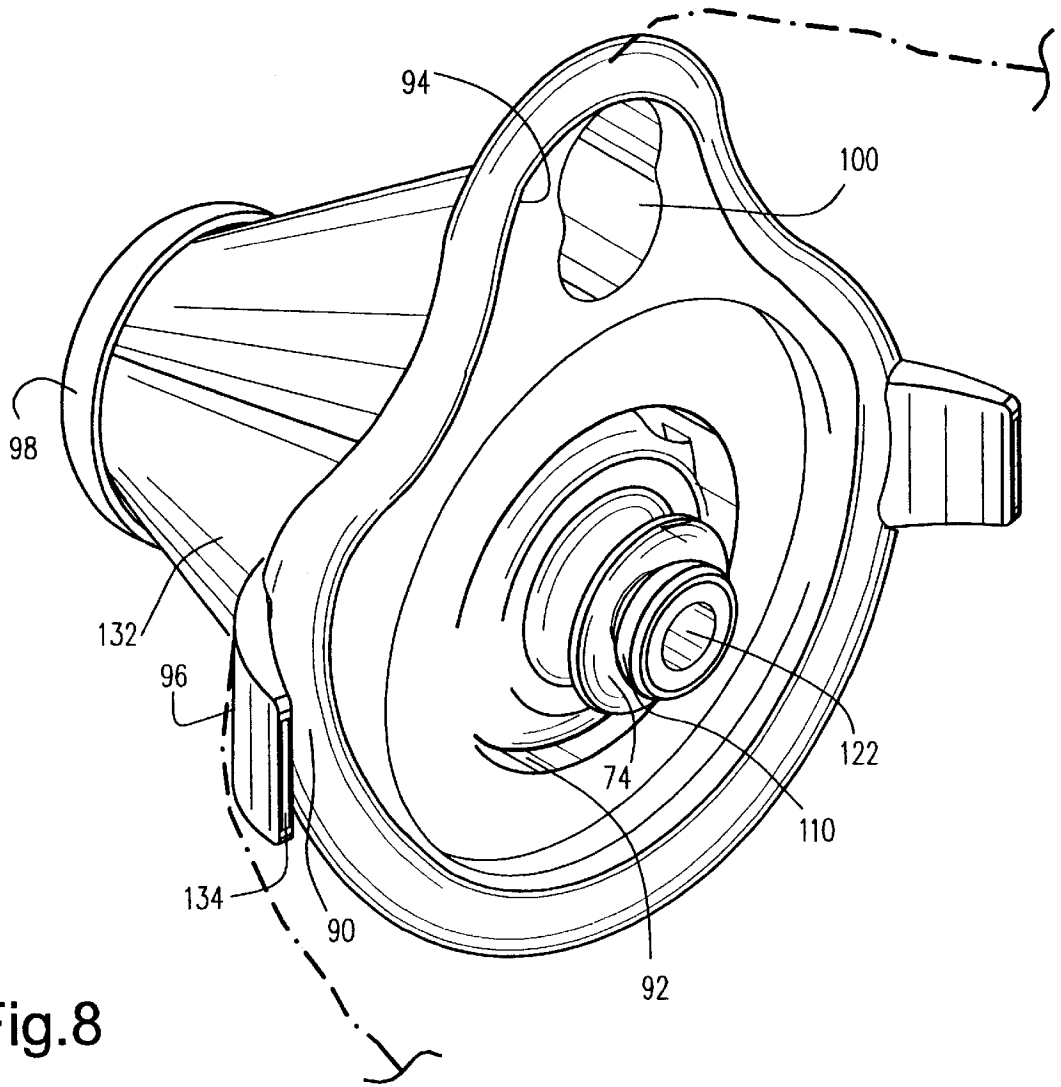
FIG. 8 is a view similar to FIG. 7 illustrating the system in its assembled condition.

Referring now to the drawings, particularly to FIG. 1, there is illustrated a personal disposable emergency breathing system, generally designated 10, and comprising in major parts thereof a body 12, a filter 14, an outer protective shell 16, an air inlet guard 18, and a mouthpiece 20, collectively forming an oral-nasal mask 21 (FIG. 2). A hood 22 is attached to the mask 21. The body 12 is preferably formed of an elastic non-porous material, such as neoprene, and includes opposite inner and outer surfaces 24 and 26, respectively, (FIG. 2). Body 12 is in the general shape of the frustum of a cone with the large diameter end corresponding to a first, i.e., inner, surface 24, and the small diameter end corresponding to a second, i.e., outer, surface 26. Body 12 includes along its inner surface 24 a nasal cavity 28 and an oral cavity 30. The body 12 also includes a central aperture 34 which receives the mouthpiece 20 and which aperture opens into a chamber 36 opening through the outer or second surface 26 of body 12. Additionally, body 12 includes an enlarged peripheral bead 38 formed about the inner surface 24 for sealing against the individual's face about the nose and mouth.

Additionally, an intermediate seal 37 is formed on the inner surface 24 inwardly of and spanning between portions of the perimetrical seal 38. Seal 37 extends above the individual's mouth and below the nostrils (nose) upon application of the mask to the individual's face, isolating nasal and oral cavities one from the other. As will be appreciated from the ensuing description, the perimetrical seal 38 forms an outer seal about the individual's oral and nasal cavities, the seal 37 forms an intermediate seal above the individual's mouth and the mouthpiece and a further or interior seal is formed by the individual's lips about the mouthpiece as described below.

The filter 14 is preferably a composite filter and may have multiple stages for filtering specified toxic gases. In a preferred embodiment, the first stage 40 comprises a particulate filter for screening particles from the air passing into the system. The particulate filter may be formed of any number of known materials serving as particulate filters such as spun polyester or may comprise a Hepa filter. The intermediate stage 42 preferably comprises a bed of activated carbon granules. The carbon granules remove polar organic gases, e.g., benzene, cyanides and the like, and acid gases from the air passing through the filter. The final filter stage 44 comprises a ceramic filter for converting carbon monoxide to carbon dioxide by a catalyzation process and may, for example, contain palladium and platinum for that purpose. The stages 40, 42 and 44 of the filter 14 are preferably provided within a cylindrical housing as a unitary air filtration unit. As illustrated in FIG. 2, the outer surface 26 of body 12 has a radially inwardly directed rib or bead 46 which, upon insertion of the filter 14 into the chamber 36 through the opening in the second or outer surface 26, serves to retain the filter 14 within body 12. Rib-and-groove arrangements may cooperate between the canister and the interior surface of the chamber 36 to provide additional retention capability for retaining the filter 14 within the body.

Surrounding the frustoconical outer surface of body 12 is a rigid shell 16. The shell, for example, may be formed of a polycarbonate. The body 12 adjacent the perimetrical seal 38 has a perimetrical indentation 50 which receives a correspondingly shaped, perimetrically extending arcuate flange 52 formed adjacent the inner end of the outer shell 16. Consequently, the outer shell 16 can be received about the frustoconical body 12 with the flange 52 engaging in the recess 50 to retain the outer shell on the body 12. One or more additional rib-and-groove arrangements may be provided as necessary between the body 12 and shell 16 to retain the two elements in assembly.

Attached to the outer end of and projecting from the outer shell 16 is guard 18. Guard 18 is in the form of a protective cap, is generally circular and has marginal flanges 58. Fasteners project from the end of shell 16 at circumferentially spaced positions thereabout to retain the protective cap on the end of the shell. Because the protective cap 18 is spaced from the end of the shell, an annular air passage 59 is provided for ingress of air into the inlet of the filter 14. Preferably, the cap 18 mounts a luminous disk 60 which is responsive to light to provide a luminescence under smoke conditions.

The mouthpiece 20 includes a shaped, e.g., bulbous, bite block 62 forming a first or inner part 63 of a mouthpiece body 64 defining a central passage 66 through the mouthpiece. The mouthpiece body 64 includes a second part 67 which terminates at its outer end in a flange 69 which extends radially outwardly, bearing against a portion of the interior surface of the chamber 36 to retain the mouthpiece 20 in the aperture 34. The first part 63 terminates at its forward end in a rectilinear section which overlies an inner rectilinear end of the second part 67, the parts being suitably secured to one another. Alternatively, the parts 63 and 67 can be integrally formed. The sides of the mouthpiece body carry a pair of flap-type exhalation valves 68, enabling outflow of exhaled air from the mouthpiece into the hood cavity past the seal 38 and into the hood 22. Simultaneously, the exhalation valves 68 prevent inflow of exhaled air into the mouthpiece passage 66. Additionally, a one-way inlet check valve 70 is provided adjacent the outer end of the mouthpiece, enabling filtered air to enter the mouthpiece and preventing backflow of exhaled air through the inlet valve into the filter. Thus, because the hood 22 surrounds the individual's head and connects to the mask outwardly of seal 38, the air exhaled through the exhalation valves 68 escapes past the seal 38 into the hood and maintains the interior of the hood at a pressure above the pressure of the air surrounding the hood.

The bite block 62 of mouthpiece 20 is shaped such that the forward surfaces 72 thereof converge in a forward direction. This enables the individual's teeth to extend about surfaces 72 and, when the individual bites down on surfaces 72, the mask 21 is drawn, i.e., biased for movement, toward the individual's face. Additionally, a flange 74 projects radially from the mouthpiece forwardly of the bulbous bite block 62. The flange 74 has an inner outwardly tapered surface which serves as a further seal when engaged by the individual's lips, preventing passage of any exhaled air or air within the hood past the mouthpiece into the individual's mouth. It will be appreciated that by forming the converging surfaces on the forward portion of the bite block 62, the mouthpiece and hence the mask 21, is drawn or biased toward the individual's face, maintaining the seal 37 between the individual's nose and mouth and peripheral seal 38 along the inner or first surface 24 about the individual's face.

Referring now to the embodiment hereof illustrated in FIGS. 4–7, there is provided a mask including an elastic non-porous body 90 (FIG. 7) having a central cylindrical or rectilinear chamber 92, preferably cylindrical, opening through an inner or first face 94 thereof and covered by a hard, preferably plastic, frustoconical shell 96 (preferably a polycarbonate) terminating at its forward end in a protective cap 98 spaced from the forward end of the mask. The chamber 92 opens through a reduced diameter opening at the forward end of the mask into an annular passage through which inlet air is received through a filter 93 forming part of a sub-assembly, to be described. The inner or first face 94 of body 90 includes a nasal cavity 100 with pinch pads on opposite sides for closing the individual's nasal passage upon application of the mask to the individual's face. The chamber 92 opens through the inner face 90 and includes a pair of side slots 104, each of which opens at opposite ends into chamber 92.

The breathing system of FIGS. 4–7 also includes a sub-assembly, generally designated 106, comprised of an air filter, for example, containing air filtration modules or layers similar to those of the filter unit 14, housed within a cylindrical casing 108. Alternatively, the filter modules may be disposed directly into the neoprene body thereby eliminating the hard casing 108. The sub-assembly 106 terminates at its inner end in a mouthpiece 110 having an outer bulbous configuration 112 forming a bite block, similarly as in the previous embodiment. A seal 114 in the form of a flange provides a generally annular sealing surface spaced from and about the bite block 110. It will be appreciated that when an individual bites down on the bite block 110, the sub-assembly 106 and the attached body 90 is biased toward the individual's face, with the individual's lips forming a seal with flange 114.

The mouthpiece 110 includes a central passage 122 in communication with a pair of air outlet openings 123 from the air filter 93. Exhalation passages 130 also lie in communication with central passage 122 and extend through respective side exhalation ducts 132. Disposed in the central passage 122 are pairs of inhalation and exhalation check valves 124 and 126, respectively. The check valves 124 and 126 comprise a pair of angularly related flaps, respectively, which are preferably integrally formed and pivot jointly. Consequently, it will be appreciated that during inhalation, the inhalation check valves 124 are spaced from the outlet openings 123 to the air filter whereby filtered air flowing through the air filter 93 flows past the open check valve 124 into the passage 122 and into the individual's mouth. Simultaneously, the exhalation check valves 126 close the exhalation passages 130 through side ducts 132. Upon exhalation, the pressure of the exhaled air closes the exhalation valves 124. That is, flaps 124 are displaced into the dashed line positions illustrated in FIG. 4, closing air inlet openings 123. Simultaneously, the exhalation valves 126 are displaced into open positions, also illustrated by the dashed lines in FIG. 4. Consequently, upon exhalation, exhaled air passes through the exhalation passages 130 and flows outwardly of the mask through the ducts 132 and into the hood. Other types of check valves 124 and 126 may be utilized.

To install the sub-assembly 106 in the body 90, the air filter and its housing 108 are disposed in the cylindrical chamber 92 through the open end of the body along the inner or first surface 90 thereof. Because the body 90 is formed of an elastic material, the ducts 132 may be inserted from within chamber 92 into the slots 104. As a consequence, the outlets 134 for the ducts 132 straddle the individual's mouth along his/her cheeks, emptying the exhaled air from the passages 130 into the hood about the individual's head.

It will be appreciated that in both embodiments of the present invention, the air filters are replaceable. That is, once the units have been used, they may be removed from the mask and replaced with fresh filters. As in the preceding embodiment, it will be appreciated that the sole mechanism for maintaining the mask on the individual's face with the perimetrical seal, the intermediate seal and the inner seal in sealing relation about the individual's face is the cooperation between the individual's teeth and the bite block. The mask does not utilize a strap to hold the mask onto the individual's face. The bite block, in combination with the seals, provides a comfortable and stable interface between the mask and the individual's face. While the outer seal is provided to form a barrier between the interior of the hood and the individual's mouth, the seal about the bite block is the most effective seal, since the individual will bite down on the bite block with a degree of force sufficient to cause the individual's lips to engage the inner seal.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A personal emergency breathing system comprising:

a shaped body formed of an elastic non-porous material having along a first surface thereof a perimetrical seal for sealing about an individual's nose and mouth;

a mouthpiece carried by said body and projecting from said first surface thereof terminating in a bite block for gripping by the individual's teeth, said bite block being shaped to draw the body toward the individual's face to maintain the seal about the individual's nose and mouth upon the individual biting down on the bite block;

said body having a chamber with an opening through said first surface and in communication with said mouthpiece, said body having a second surface opposite said first surface;

an air filter disposed in said chamber for filtering ambient air and having an air inlet for receiving ambient air and an air outlet for passing filtered air into said mouthpiece;

a substantially rigid shell about said body and extending substantially between said first and second surfaces thereof;

a hood about said first surface for enveloping an individual's head and having an opening for receiving an individual's head and neck; and first and second one-way valves carried by said mouthpiece, said first valve enabling flow of filtered air from said filter air outlet into said mouthpiece and preventing backflow of exhaled air into said filter, said second valve enabling air exhaled into said mouthpiece for flow into said hood and preventing backflow of air from said hood through said second valve to said mouthpiece.

2. A system according to claim 1 wherein said bite block includes an outwardly sloping generally outwardly converging surface for gripping by the individual's teeth and biasing the body for movement in a direction toward the individual's face to maintain the sealing contact between the perimetrical seal and the individual's face about the nose and mouth.

3. A system according to claim 1 wherein said air filter is removably carried by said body in said chamber.

4. A system according to claim 1 wherein said body has a nasal cavity in said first surface for receiving an individual's nose, and nasal pressure pads carried by said body for closing the individual's nose.

5. A system according to claim 1 wherein said filter comprises a filter canister including a particulate filter, a carbon filter and a monolithic filter for converting carbon monoxide to carbon dioxide.

6. A system according to claim 1 wherein margins of said hood about said seal are disposed between peripheral margins of said body and said shell adjacent said seal.

7. A system according to claim 1 wherein said body is formed of neoprene.

8. A system according to claim 1 including a second seal inwardly of the perimetrical seal for in part sealing about the individual's nose.

9. A system according to claim 1 including a seal carried by said mouthpiece for forming a seal with the individual's lips when the bite block is gripped by the individual teeth.

10. A system according to claim 1 including a removable protective element substantially overlying said chamber opening and spaced from said body defining an air inlet port to said opening and the air inlet to said filter.

11. A system according to claim 1 wherein said air filter is receivable through the opening in said second surface, a removable protective element substantially overlying said chamber opening and spaced from said body defining an air inlet port to said opening and the air inlet to said filter.

12. A system according to claim 1 wherein said mouthpiece, valves and air filter form a sub-assembly, a pair of exhaust ducts extending along opposite sides of said sub-assembly, said body including a pair of slots opening through said first surface and into said chamber, said ducts being received in said slots, respectively, and said air filter being received in said chamber.

13. A system according to claim 12 including a removable protective element substantially overlying said chamber opening and spaced from said body defining an air inlet port to said opening and the air inlet to said filter.

14. A personal emergency breathing system comprising:

a mask including a shaped body formed of an elastic non-porous material having along a first surface thereof a perimetrical seal for sealing about an individual's nose and mouth;

a mouthpiece carried by said body and projecting from said first surface thereof terminating in a bite block for gripping by the individual's teeth, said bite block being shaped to draw the mask toward the individual's face to maintain the seal about the individual's nose and mouth upon the individual biting down on the bite block;

said body having a chamber with an opening through said first surface and in communication with said mouthpiece, said body having a second surface opposite said first surface;

an air filter disposed in said chamber for filtering ambient air and having an air inlet for receiving ambient air and an air outlet for passing filtered air into said mouthpiece;

said mask including a substantially rigid shell about said body and extending substantially between said first and second surfaces thereof;

a hood carried by said mask about said first surface for enveloping an individual's head and having an opening for receiving an individual's head and neck; and first and second one-way valves carried by said body, said first valve enabling flow of filtered air from said filter air outlet into said mouthpiece and preventing backflow of exhaled air into said filter, said second valve enabling air exhaled into said mouthpiece for flow into said hood and preventing backflow of air from said hood through said second valve to said mouthpiece.

15. A system according to claim 14 wherein said bite block includes an outwardly sloping generally outwardly converging surface for gripping by the individual's teeth and biasing the mask for movement in a direction toward the individual's face to maintain the sealing contact between the perimetrical seal and the individual's face about the nose and mouth.

16. A system according to claim 14 wherein said air filter is removably carried by said body in said chamber.

17. A system according to claim 14 wherein said body has a nasal cavity in said first surface for receiving an individual's nose, and nasal pressure pads carried by said body for closing the individual's nose.

18. A system according to claim 14 including a second seal inwardly of said perimetrical seal for in part sealing about the individual's nose.

19. A system according to claim 14 including a seal carried by said mouthpiece for forming a seal with the individual's lips when the bite block is gripped by the individual teeth.

20. A system according to claim 14 wherein said mouthpiece, valves and air filter form a sub-assembly, a pair of exhaust ducts extending along opposite sides of said sub-assembly, said body including a pair of slots opening through said first surface and into said chamber, said ducts being received in said slots, respectively, and said air filter being received in said chamber.

* * * * *